United States Patent [19]

Michel

[11] 4,250,817

[45] Feb. 17, 1981

[54] BURNER FURNACE FOR SOLID FUELS AND A METHOD OF BURNING DIFFERENT KINDS OF SOLID FUEL IN THIS FURNACE

[75] Inventor: Walter Michel, Murg, Baden, Fed. Rep. of Germany

[73] Assignee: Thermo Murg K.G., Murg, Baden, Fed. Rep. of Germany

[21] Appl. No.: 950,537

[22] Filed: Oct. 10, 1978

[30] Foreign Application Priority Data

Apr. 10, 1978 [DE] Fed. Rep. of Germany ..... 2815486

[51] Int. Cl.[3] ..... F23K 3/02

[52] U.S. Cl. ..... 110/104 R; 110/104 B; 110/101 CF; 110/106; 110/263; 222/330

[58] Field of Search ..... 110/104 R, 104 B, 105, 110/106, 101 R, 101 C, 101 CF, 115, 263; 432/1, 49, 51; 222/330

[56] References Cited

U.S. PATENT DOCUMENTS

| | | | |
|---|---|---|---|
| 2,158,673 | 5/1939 | Carter et al. | 110/104 R |
| 2,547,794 | 4/1951 | Stone | 222/330 |
| 2,772,032 | 11/1956 | Pattillo | 222/330 |
| 3,031,110 | 4/1962 | Verheyden | 222/330 |
| 3,033,134 | 5/1962 | Hennecke | 110/104 R |
| 3,303,822 | 2/1967 | Cohen | 222/330 |
| 4,092,094 | 5/1978 | Lingl, Jr. | 110/106 |
| 4,131,072 | 12/1978 | Lingl, Jr. | 110/106 |
| 4,173,188 | 11/1979 | Pearce | 110/106 |
| 4,182,245 | 1/1980 | Stewart et al. | 110/101 CF |

*Primary Examiner*—Henry C. Yuen

*Attorney, Agent, or Firm*—Michael J. Striker

[57] ABSTRACT

The method of burning different sorts of solid fuel in a tunnel-like burner furnace comprises the steps of pulverizing the solid fuel particles to a size corresponding to optimum burning performance of the employed burners, supplying the pulverized particles in an air stream to the burners of the furnace and adjusting the supplied amount of pulverized particle-air mixture, and the amount of air in the mixture in accordance with the optimum burning performance of the burner. The burner furnace system for performing the method of this invention comprises a tunnel burner furnace having a plurality of ceiling burners and of side wall burners, a fuel distributor having a rotatable distributing channel communicating successively with respective burners and a dosing device connected to the input of the fuel distributor and adapted for adjusting the stream of the mixture of air with pulverized fuel particles.

29 Claims, 12 Drawing Figures

Fig. 5
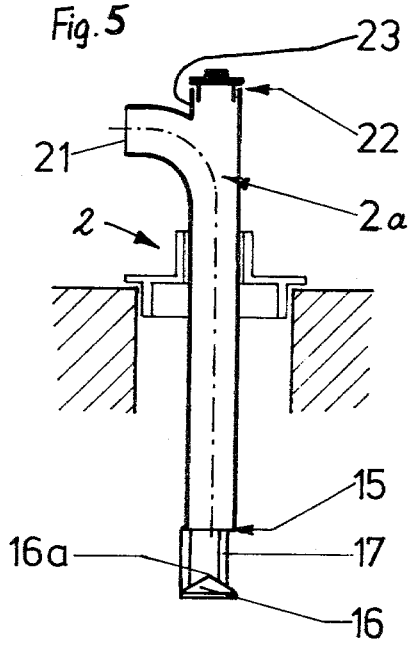
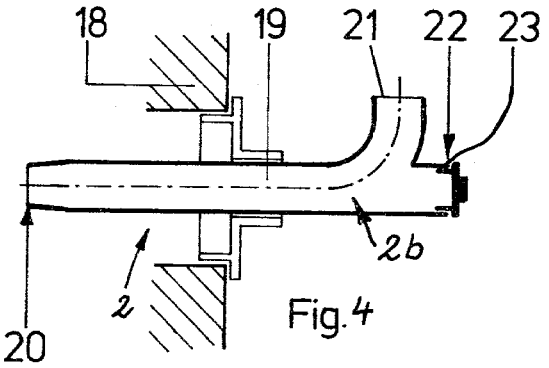
Fig. 4
Fig. 7
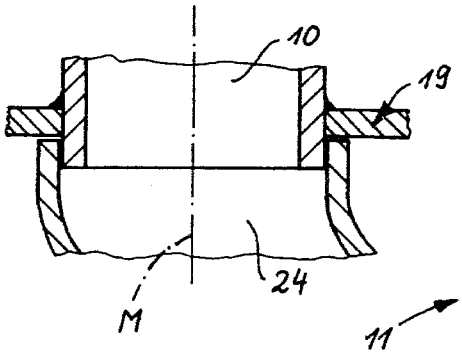
Fig. 8
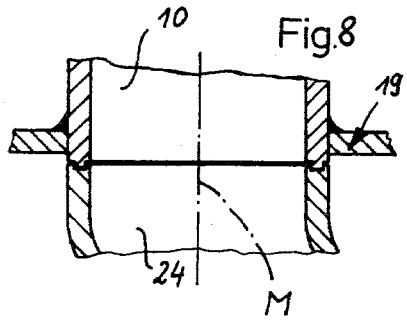
Fig. 6
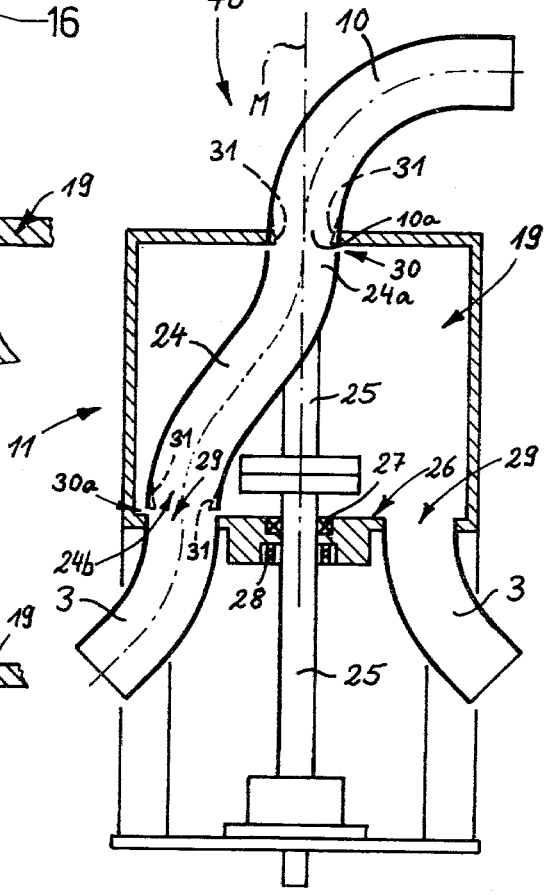

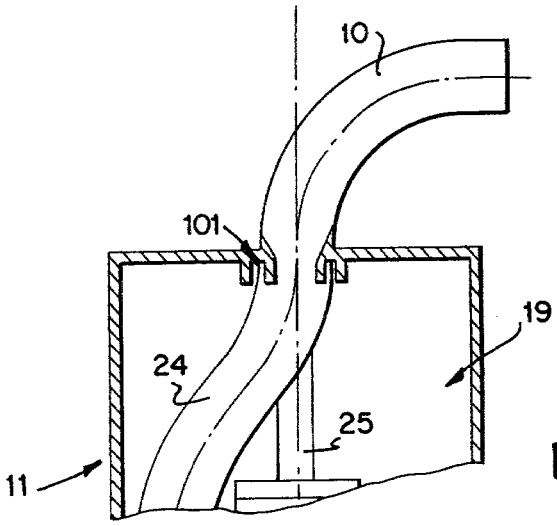
FIG. 11
FIG. 12
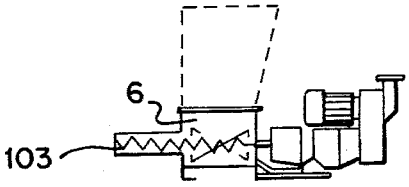

BURNER FURNACE FOR SOLID FUELS AND A METHOD OF BURNING DIFFERENT KINDS OF SOLID FUEL IN THIS FURNACE

BACKGROUND OF THE INVENTION

This invention relates generally to solid fuel operated burner furnaces, and more particularly it relates to tunnel burner furnaces capable of selectively burning different kinds of solid fuels and the invention relates also to a method for burning solid fuels in such furnaces.

Burner furnaces such as ceramic burner furnaces operable on the basis of burning method utilizing solid fuels especially coal are known from the prior art. Such conventional burner furnaces possess, however, different disadvantages. For example, the desired temperature distribution within the furnace and a uniform heat transfer is frequently unattainable and this deficiency may have an ill effect on the fired product. In addition, the operation of conventional burning furnaces of this type is mostly expensive and requires a corresponding attendance. Furthermore, it is disadvantageous that known burner furnaces are designed only for the application of a specific solid fuel material.

SUMMARY OF THE INVENTION

It is therefore a general object of the present invention to overcome the aforementioned disadvantages.

More particularly, it is an object of the invention to provide a method of burning solid fuel in burner furnaces that makes it possible to use selectively and alternately different sorts of fuel material.

Another object of the invention is to provide an improved burner furnace that can be selectively and alternately operated with different kinds of solid fuels without the necessity of changing the arrangement of the burner system.

A further object of the invention is to provide an improved burner furnace that enables uniform distribution of temperature over the entire area of the burning zone.

An additional object of the invention is to provide an improved burner furnace that operates economically that means that the supplied solid fuel material is utilized with maximum efficiency.

In keeping with these objects, and others which will become apparent hereafter, one feature of the invention resides, in a tunnel burner furnace, in a burning method which comprises the steps of adjusting the size of solid fuel particles in accordance with the optimum burning action of the burners used in the furnace, supplying the adjusted solid fuel particles in an air stream into the burner for combustion and adjusting the supplied fuel particle-air mixture and the air in this mixture in accordance with the optimum burning performance.

This method is suitable for burning besides coal also other solid fuel materials such as for example saw dust, crushed olive stones, peanut shells, byproducts of coffee, stone coal and the like. In pulverizing such solid fuel materials, the grain size is always selectively adjusted to the burning properties of particular burners in the furnace so that inspite of different fuel materials an approximately uniform burning process takes place. It is thereby of advantage that the forced draft combustion provided in the furnace enables also a simple pneumatic feeding of the crushed fuel material. Different fuel materials have in this process similar grain sizes, only the percentage of proportions of the fuel gradated according to the size varies according to the burning speed.

In a further elaboration of the invention, the tunnel burner furnace is provided with a plurality of ceiling burners and side wall burners. Especially in the case of side wall burners the grain sizes and the air supply is so regulated that substantially uniform distribution of the solid fuel grains results during their falling through the burner channel.

It is particularly advantageous when solid fuel material is blown into the burner channel in impulses, particularly, when it is consecutively supplied to different feeding points with time shift matching the burning speed of the fuel. In this manner savings on fuel will result and the impulse-like injection of the fuel particles-air mixture improves and equalizes the temperature distribution.

The invention is also concerned with the burner furnace for carrying out the above burning method. Such a furnace is suitable particularly for use in manufacturing ceramic products and includes one or more heating sections each having a plurality of burners arranged on the ceiling and at the side walls for burning the supplied fuel material, as well as a feeding and dosing device for the fuel. The burner furnace according to this invention is characterized particularly by fuel distributors assigned respectively to the heating sections of the furnace; the inlet of the fuel distributor is connected to the dosing device and the outlet side is provided with a plurality of outlet channels communicating with the inlets of respective burners in the furnace. By means of this arrangement, a substantially uniformly distributed feeding of the solid fuel materials is achieved that facilitates uniform combustion and moreover it eliminates non-operative time periods of the furnace during which no fuel is available for burning.

Preferably, the fuel distributor has an inlet channel, a distributing head communicating with the channel and a plurality of outlet channels. By means of the fuel distributor the burners arranged in groups in a cross-section of the furnace are supplied with fuel via the outlet channels in time shifted periods.

In a particularly advantageous embodiment of the fuel distributor, the distributing head has a housing hermetically connected both to the fuel supply inlet channel and to the outlet channels and a distributing channel that is rotatably supported within the housing. Due to the dust-tight design of the distributor housing, no fuel dust can be discharged from the distributor.

It is also of advantage when each heating section of the furnace is provided with a temperature sensor or a thermal element connected to a device for regulating the feeding of the fuel material. By this regulating device it can be achieved a practically automatic operation of the feeding equipment that delivers such amounts of fuel that are adjusted to the burning parameters of employed burners in the furnace.

The burners that are arranged proximately vertically in the ceiling of the tunnel burner furnace are provided at their discharge apertures with deflecting elements. The supplied fuel material is thus distributed in a plane of the deflecting elements so that it is possible to employ a reduced number of the ceiling burners. Moreover, the solid fuel particles remain suspended for a longer time whereby a favorable temperature distribution is attainable.

It is further of advantage when lateral burners provided in the side walls of the furnace are slightly inclined relative to the horizontal to have their outlet aperture directed upwardly whereby as the case may be the inclined position is adjusted to the speed of feeding of the fuel material, to the kind of the fuel material as well as to the size of the combustion space. Also by this means it can be attained that the fuel material is more uniformly distributed over the cross-sectional area of the furnace.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a sectional side view of a lateral burner arranged in a side wall of the furnace;

FIG. 5 is a sectional side view of a ceiling burner arranged in the ceiling of the furnace;

FIG. 6 is a modified embodiment of the fuel distributor according to this invention;

FIGS. 7 and 8 are sectional side views of cut-away parts of junctions between a fuel supply channel and a distributing channel in a fuel distributor;

FIG. 11 is a sectional view of a cut-away part of a modification of the fuel distributor of FIG. 6; and FIG. 12 is a schematic sectional view of a worm conveyor in the fuel feeding device.

DESCRIPTION OF THE PREFERRED EMBODIMENTS

Figure 1:
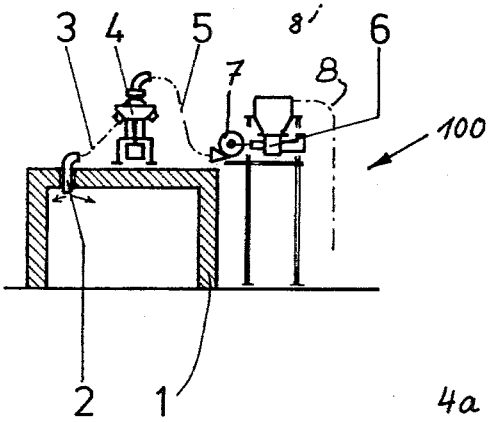
FIG. 1 is a cross-sectional side view of a tunnel burner furnace with fuel feeding devices.

A burner furnace system identified in FIG. 1 by reference numeral 100 includes a furnace 1 that can have a form of a tunnel furnace (FIG. 2) or of a chamber or compartment furnace having a ceiling burner 2. Solid fuel such as for example coal, saw dust and the like is first crushed into grains having a suitable size for application in the burner 2, delivered into a dosing device 6 and therefrom is pneumatically supplied by means of an air blower 7 to a fuel distributor 4. Subsequently the solid fuel-air mixture is supplied to the solid fuel burner 2 that can be made either in the form of ceiling burners 2*a* (FIG. 5) or as lateral burners 2*b* (FIG. 4).

Figure 2:
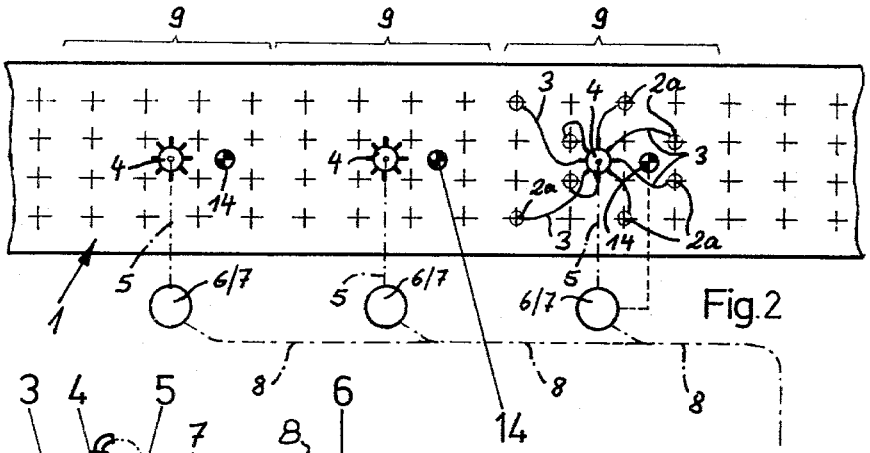
FIG. 2 is a top view of a cut-away part of a tunnel burner furnace.
Figure 10:
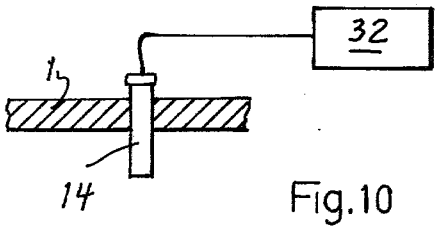
FIG. 10 is a temperature sensor in connection with a schematically shown control device.

FIG. 2 shows in a top view a cut-away part of a tunnel furnace in which three heating sections 9 each including an array of burners 2 are arranged. The array or group of burners 2*a* in each heating section is provided with a fuel distributor 4 connected to respective burners 2*a* by fuel outlet conduits 3. For the sake of clarity, burners 2*a* are illustrated only in one of the heating sections 9. Connection pipes 5 connecting the inlet of the distributor 4 to the blowers 7 of dosing devices 6 shown schematically by circles as well as the fuel supply conduits 8 leading to these devices are indicated by dash and dot lines. The groups of burners 2*a* assigned to respective fuel distributors 4 are uniformly arranged over the entire cross-sectional area of the corresponding furnace sections. The individual heating sections 9 in order to achieve different temperatures along the tunnel furnace 1 if desired can be supplied during the operation of the tunnel furnace with different amounts of burning material. In the burner system according to this invention it is also possible to supply respective burners within each heating section 9 with different amounts of fuel material especially the burners close to the walls of the furnace receive different doses of solid fuel than the burners in the central range of the heating section. FIG. 10 shows a temperature sensor 14 in connection with a control device 32.

As it has been already mentioned above, the solid fuel material is first crushed to have a predetermined grain size according to the sort of the used fuel material and then is delivered in the form of a mixture of the pulverized fuel material-air for combustion. The grain size of each sort of fuel material is selected so that during the free fall of the loose fuel material in the entire cross-sectional area of the burner channel the necessary amount of the fuel material burns out.

By the aid of the fuel distributor 4 and measuring devices, especially temperature sensors and feeding regulators as it will be explained below, the solid fuel material is delivered in impulses according to operational needs whereby individual doses of fuel are consecutively fed to different points at different time intervals in accordance with combustion speed of the fuel material.

In order to regulate the feeding of solid fuel a temperature sensor 14 (FIG. 2), preferably a thermocouple is assigned to each heating section 9. In addition the fuel distributors 4 are controlled by an adjustable time switch 102 (FIG. 3) to operate in predetermined working intervals.

Figure 3:
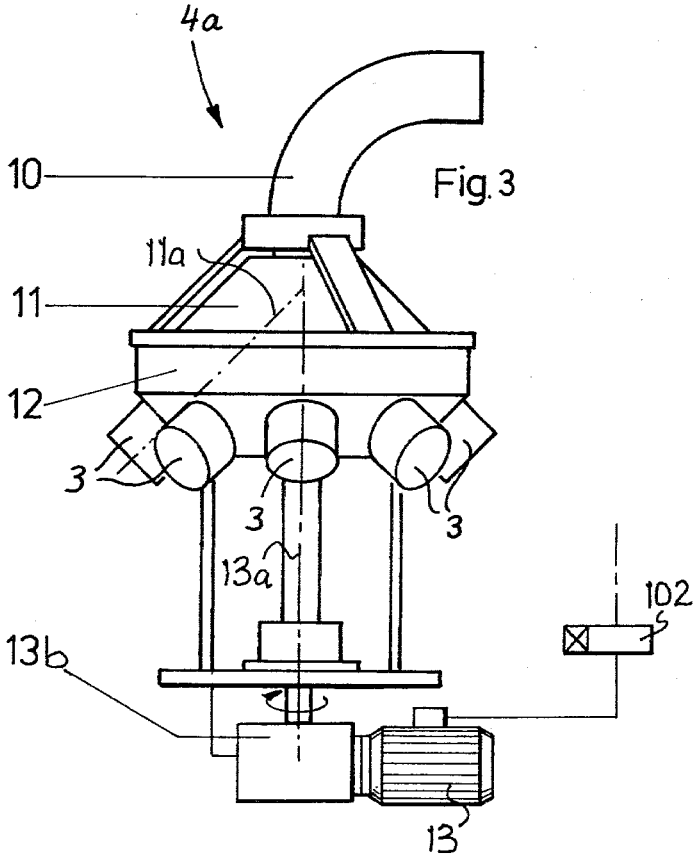
FIG. 3 is a perspective view of a fuel distributor in the burner furnace according to this invention.

FIG. 3 shows one embodiment of the fuel distributor 4*a*, consisting of a stationary fuel inlet channel 10, a fuel distributing head 11 communicating with the channel 10 and cooperating with a plurality of fuel outlet conduits 3. In this embodiment of fuel distributor 4*a* the distributing head 11 is rotatably supported on a stationary base 12 whereby a distributing channel 11*a* schematically illustrated by dash-dotted line within the distributor head 11 is brought in alignment with one of the fuel outlets 3 arranged on the stationary base 12. The fuel outlets 3, as mentioned above, are connected to respective burners 2*a* and in this manner the latter are periodically supplied with solid fuel.

The fuel distributor 4 can be provided with for example three to ten, preferably with eight fuel outlets 3. A motor 13 controlled by the time switch 102 serves for driving via a shaft 13*a* and gears 13*b* the rotary distributing head 11.

The burner furnace 1 can be provided both with ceiling burners 2*a* (FIGS. 1, 2 and 5) and/or with lateral burners 2*b* (FIG. 4). The ceiling burner 2*a*, shown in detail in FIG. 5, is arranged substantially vertically in the ceiling of the furnace and has at its outlet aperture 15 projecting into the interior of the furnace, deflecting elements including a deflecting plate 16 spaced apart from the center of the outlet aperture of the burner 2*a* about a small distance. This arrangement enables a particularly advantageous distribution of the fuel in the furnace that favorably influences the uniformity of combustion. As a result the injection speed of the fuel can be reduced and the stay time of the fuel material in suspension can be with advantage increased.

The deflection plate 16 is connected to the rim of the outlet aperture 15 of the burner by means of arms 17. The deflection plate 16 has a tapered or pyramidal configuration facing with its tip 16 approximately the center of the aperture 15 of the ceiling burner 2*a*.

The lateral burners 2*b* (FIG. 4) have no deflecting elements at their outlet apertures. They are arranged in the side walls 18 of the furnace 1 and are arranged either horizontally or having their outlet 20 slightly inclined upwardly relative to the horizontal. The inclined position of the lateral burner can be adjusted according to the feeding speed of the fuel material, the kind of the feeding material, and also to the size of the combustion space. The inclined position is also dependent on the level of installation of the lateral burners 2*b* (see FIG. 9).

As illustrated in FIGS. 4 and 5, the burners 2*a* and 2*b* are provided with connecting pieces 21 directed approximately transversely to their longitudinal axis for being connected to the fuel outlet 3 of the distributor 4. The ceiling burner 2*a* has also at its outwardly projecting end 22 an auxiliary outlet 23 normally closed by a cap.

FIG. 6 shows a preferred embodiment of the fuel distributor 4*b*. In this embodiment, a stationary housing 19 is hermetically connected at its top to a fuel inlet channel 10 and at its bottom with fuel outlet channels 3. A rotary fuel distributing channel 24 is supported within the housing 19 in such a manner that its top end opening 24*a* communicates with the centrally arranged opening 10*a* of the fuel inlet channel 10. The lower end 24*b* of the distributing channel 24 is offset from its axis M of rotation so that it periodically is in alignment with the inlet opening 29 of one of the fuel outlet channels 3 arranged on a circle around the axis of rotation. A driving shaft 25 aligned with the axis M of rotation passing through the center of the outlet opening 10*a* of the fuel inlet channel 10 connects the distributing channel 24 with a rotary drive. A projecting part of the drive shaft 25 is supported for rotation outside the closed housing 19 and driven by a driving motor (not shown). If applicable, there is a possibility to install a sealed driving motor within the housing 19. The shaft 25 passes through a dust-tight ring 27 and a bearing 28 arranged in a passageway in the bottom 26 of the housing 19. In this embodiment of the fuel distributor, it is sufficient to employ a simple circumferential sealing ring 27 that is not susceptible to failures. In the compact connection of the eccentrically arranged fuel outlet channels 3 to the substantially closed housing 19 and the passageway for the driving shaft for the rotary distributing channel 24 with a simple sealing ring results in a high failure resistance at generally good tightness.

FIGS. 7 and 8 illustrate possible measures for reducing existing minute leakage of the solid fuel dust through the transition gaps 30 and 30*a* into the interior of the housing 19. According to FIG. 7, the end portion of the fuel inlet channel 10 projects slightly into the inlet end of the rotary distributing channel 24 so that apart from an improved sealing effect it is achieved that the upper end portion of the distributing channel has additional support and guidance for its rotary movement.

FIG. 8 shows another variation of the guiding and sealing connection between the stationary fuel inlet channel 10 and the rotary fuel distributing channel 24. The sealing connection has the form of an annular rib and groove whereby the end surfaces of the inlet channel and of the distributing channel engage each other.

As shown in FIG. 11, an annular guiding groove 101 can be formed on the inner surface of the upper side of the housing 19 to slidably engage the upper end portion of the rotary distributing channel 24.

It should be noted that in the fuel distributor 4*b* the minute, in practice negligible leakage of fuel dust through the transition gaps 30 and 30*a* has no ill effect since due to the gap losses a slightly increased pressure builds up within the housing 19 relative to the pressure in the interior of the furnace and this overpressure discharges the fuel dust through the unoccupied fuel outlet channels 3 into the combustion space. No dust can leak out of the closed housing 19.

If applicable, the fuel inlet channel 10 can have at its discharge end facing the distributing channel flow guiding means 31 to deviate inwardly the stream of the fuel-air mixture from the transition gap 30.

Similar flow guiding element 31 can be formed in the discharge end of the distributing channel 24.

The above-described burner furnace system 100 according to this invention can consume as fuel material, apart from ground coal, also saw dust, crushed olive stones, crushed peanut shells, soft coal, waste products from coffee and the like. In this respect it is important that the burner furnace according to this invention can handle alternately these different crushed solid fuel materials practically on its own premises without the need of any structural changes. In order to attain approximately the same combustion conditions at different fuel materials only the feeding devices and dosing devices 6 are adjustable to match the different fuel materials. This adjustment can be made for example by exchanging the worm wheel in the feeding device or by changing the size of the dosing worm conveyor in the dosing device.

The advantageous feeding of the fuel material into the furnace 1 results in a distribution of the fuel material that matches the optimum working parameters of the burners and consequently it results in optimum temperature conditions in the furnace.

Figure 9:
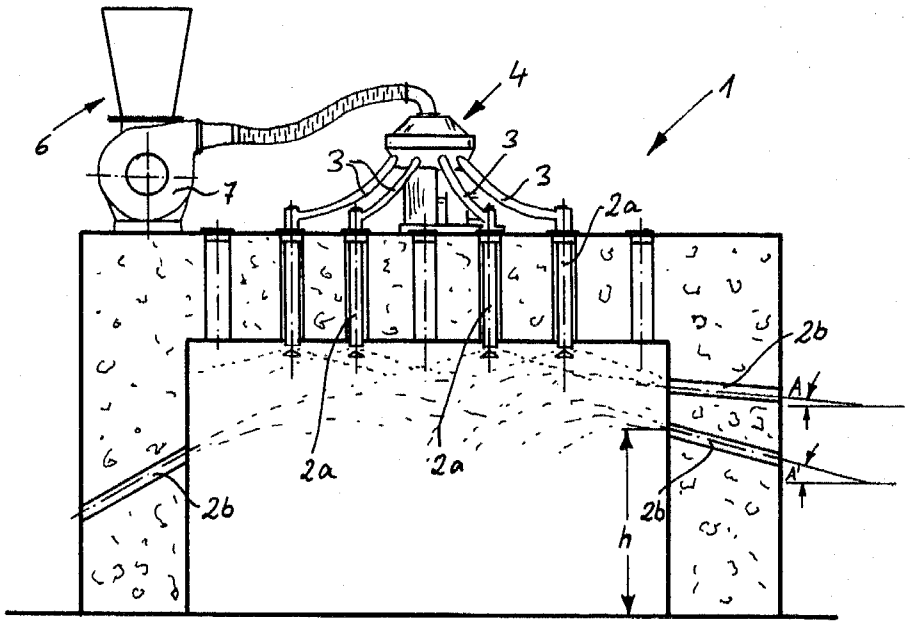
FIG. 9 is a sectional side view of a tunnel burner furnace according to this invention.

FIG. 9 shows a burner furnace 1*b* that is also equipped with ceiling burners 2*a* and with lateral burners 2*b*. The lateral burners 2*b*, that for the sake of better clarity are arranged regularly and partly in a different manner than is their arrangement in actual use, extend through the side wall of the furnace at different angles A and A′ with the horizontal. The different inclined positions of the lateral burners can be used to match the feeding speed of the fuel material, the kind of the fuel material, the level of discharge apertures and the like. It should be mentioned that the grain sizes of the fuel material can amount from the size of dust particles that means from several hundredths of a millimeter to a diameter of about 5 millimeters. The different grain sizes assist in a more uniform distribution of the fuel material in the furnace.

It will be understood that each of the elements described above, or two or more together, may also find a useful application in other types of constructions differing from the types described above.

While the invention has been illustrated and described as embodied in a tunnel-like burner furnace, it is not intended to be limited to the details shown, since various modifications and structural changes may be made without departing in any way from the spirit of the present invention.

What is claimed as new and desired to be protected by Letters Patent is set forth in the appended claims:

1. A furnace having a plurality of burners for the combustion of pulverized solid fuel material, and a device for feeding a stream of an air-fuel mixture to said furnace, comprising at least one fuel distributor having an inlet opening communicating with the feeding device, a plurality of outlet openings uniformly arranged about an axis passing through the center of said inlet opening and communicating with said burners; and a distributing channel supported for rotation about said axis and having one end thereof permanently aligned with said inlet opening and the other end thereof being offset from said axis to be selectively aligned with one of the outlet openings.

2. A furnace as defined in claim 1, having a tunnel-like configuration defining a succession of heating sections, each section including an array of uniformly distributed burners.

3. A furnace as defined in claim 1, wherein said fuel distributor has a stationary fuel feeding channel, connecting said inlet opening to said feeding device, and a plurality of stationary fuel discharging channels connecting said outlet openings to said burners.

4. A furnace as defined in claim 3, wherein said distributor has a rotary head including said fuel distributing channel.

5. A furnace as defined in claim 3, further including a closed housing, said inlet and outlet channels being firmly connected to opposite end walls of said housing and said distributing channel being rotatably supported within said housing.

6. A furnace as defined in claim 5, wherein the fuel feeding channel is connected substantially to the center of the upper side of said housing and said fuel discharging channels are arranged around the center of the bottom side of said housing.

7. A furnace as defined in claim 6, wherein the rotatable distributing channel has a substantially S-shaped configuration and being connected to a driving shaft projecting through a passageway provided in the center of said bottom side of said housing, whereby said shaft is in alignment with said axis.

8. A furnace as defined in claim 7, wherein said driving is connected to rotational driving shaft means located outside said housing.

9. A furnace as defined in claim 8, wherein said passageway includes dust-tight sealing means for said shaft.

10. A furnace as defined in claim 8, wherein a minute spacing clearance is left between the lower end of said distributing channel and the bottom side of said housing.

11. A furnace as defined in claim 10, wherein a sealing joint in the form of an annular groove is provided on the inner surface of the upper side of said housing.

12. A furnace as defined in claim 10, wherein the outlet aperture of said fuel inlet channel and the outlet aperture of said rotary fuel distributing channel are provided respectively with flow guiding means for deviating the stream of fuel-air mixture from the respective transition gaps.

13. A furnace as defined in claim 1, wherein said fuel distributor includes three to ten fuel outlet openings.

14. A furnace as defined in claim 1, wherein a driving motor for said rotary distributing channel, and a time switch adjustable for activating said motor in timed intervals determined by the kind of employed fuel material.

15. A furnace as defined in claim 1, further including temperature sensors extending into the combustion space and being connected to a control device for controlling the feeding of said fuel-air mixture into said burners in response to the detected combustion temperature.

16. A furnace as defined in claim 1, including a plurality of ceiling burners extending substantially perpendicularly into the combustion space of the furnace, and fuel stream deflecting elements arranged respectively in the range of outlet apertures of said burners.

17. A furnace as defined in claim 16, wherein said deflecting elements include a deflecting plate and means for supporting the plate at a small distance from the outlet aperture of said burners.

18. A furnace as defined in claim 17, wherein said supporting means are spacing studs connected to each burner.

19. A furnace as defined in claim 17, wherein said deflecting plate has tapering or pyramidal configuration, whereby the tip of the tapering deflecting plate being directed substantially to the center of the discharge aperture of said burners.

20. A furnace as defined in claim 1, comprising a plurality of lateral burners arranged in an upwardly inclined position in said walls of the furnace, the angle of inclination of said lateral burners being adjusted in accordance with the fuel feeding speed, the kind of the fuel material and the size of the combustion space.

21. A furnace as defined in claim 1, wherein said feeding device include worm conveyors, the worm of said conveyors being exchangeable for being adjusted to different fuel materials such as for example coal, saw dust and the like.

22. A furnace as defined in claim 1, wherein the upper end portion of each burner is provided with a short, transversely directed branch pipe connected to the assigned fuel outlet channel from said fuel distributor.

23. A furnace as defined in claim 22, wherein the outer end of said burners is open to form an auxiliary connecting piece and is normally closed by a disconnectable lid.

24. A burner system for burning pulverized solid fuel in industrial furnaces, comprising a device for feeding a stream of an air-fuel mixture to a furnace; a fuel distributor including a closed housing having in one wall thereof an inlet opening communicating with said feeding device via a fixed feeding channel, a plurality of outlet openings formed in the opposite wall about an axis passing through the center of said inlet opening, a rotary distributing channel having one end aligned with said inlet opening and the other end offset from said axis to orbit about said outlet openings, and a driving shaft connected to said distributing channel and extending through said housing; and a plurality of burners connected to respective outlet openings in said housing via fixed discharge channels.

25. A burner system as defined in claim 24, wherein said housing has at least three discharge openings.

26. A burner system as defined in claim 24, further comprising means for sealing the passage for said driving shaft in said housing.

27. A burner system as defined in claim 24, further including an annular guiding element formed about said inlet opening on the inner surface of said one wall of the housing to guide said one end of said rotary distributing channel.

28. A burner system as defined in claim 24, wherein the discharge end portions of said fixed feeding channel and of said rotary distributing channel are provided, respectively, with means for deviating said stream of fuel-air mixture toward the center of said inlet and outlet openings.

29. A burner system as defined in claim 24, further comprising means for controlling the rotation of said driving shaft.

* * * * *